United States Patent [19]

Nichols et al.

[11] Patent Number: 4,787,995

[45] Date of Patent: Nov. 29, 1988

[54] LANOLIN CONTAINING METALWORKING FLUIDS AND CONCENTRATES

[75] Inventors: Daniel R. Nichols, Milwaukee County; Curtis R. Petersen, Racine County, both of Wis.

[73] Assignee: Chem-Trend, Incorporated, Howell, Mich.

[21] Appl. No.: 13,230

[22] Filed: Feb. 9, 1987

Related U.S. Application Data

[63] Continuation of Ser. No. 730,020, May 3, 1985, abandoned.

[51] Int. Cl.[4] ..... C10M 173/00

[52] U.S. Cl. ..... 252/49.5; 72/42; 252/49.3

[58] Field of Search ..... 252/49.5, 49.3; 72/42

[56] References Cited

U.S. PATENT DOCUMENTS

| | | | |
|---|---|---|---|
| 2,625,509 | 1/1953 | Laug | 252/49.5 |
| 2,672,976 | 3/1954 | Overath et al. | 205/21 |
| 4,033,886 | 7/1977 | Felton, Jr. | 252/49.5 |
| 4,138,348 | 2/1979 | Grasshoff | 252/49.5 |
| 4,151,099 | 4/1979 | Nassy et al. | 252/49.5 |
| 4,206,059 | 6/1980 | Burton et al. | 252/18 |
| 4,212,750 | 7/1980 | Gorman | 252/49.5 |
| 4,289,637 | 9/1981 | Dulat | 252/49.5 |
| 4,390,436 | 6/1983 | Hernandez | 252/49.3 |

OTHER PUBLICATIONS

Chemical Abstracts 14817g.
Chemical Abstracts 98:164469d.
Chemical Abstracts 98:165568c.
Chemical Abstracts 98:110344w.
Chemical Abstracts 82:143910a.

*Primary Examiner*—William R. Dixon, Jr.
*Assistant Examiner*—Margaret B. Medley
*Attorney, Agent, or Firm*—Rhodes and Boller

[57] ABSTRACT

Lanolin emulsions and lanolin containing concentrates for water-based metalworking fluids are disclosed. The lanolin metalworking fluids contain water, lanolin, fatty acids, amines and nonionic surfactants. The compositions are stable in hard water.

11 Claims, No Drawings

LANOLIN CONTAINING METALWORKING FLUIDS AND CONCENTRATES

This is a continuation of co-pending application Ser. No. 730,020 filed on May 3, 1985, abandoned.

FIELD OF THE INVENTION

This invention relates to water-based metalworking fluids. More particularly, this invention relates to lanolin emulsions for water-based lubricating coolants for metalworking. Additionally, the present invention relates to lanolin containing emulsions, emulsifiable concentrates and a method of cooling and lubricating metal in a metalworking operation.

BACKGROUND OF THE INVENTION

In most metalworking operations it is generally advisable to apply fluids to lubricate and cool the metal surfaces at points of frictional contact. Metalworking fluids act, apparently by independent mechanisms, to reduce frictional heat generation by lubrication and to reduce heat build-up by conduction of heat from the surface. The primary benefits of a proper lubricating coolant in metalworking are prolonged tool life and increased speed of operations. Concurrent secondary benefits include a better surface finish and improved dimensional stability of the workpiece.

Hydrocarbon oils, including fatty acids and oils, are known to be good lubricants that reduce friction, and thereby, reduce heat generation in metalworking operations. Lanolin, in particular, is an especially good lubricant for non-ferrous metalworking. However, hydrocarbon oils, by themselves, are not effective coolants. As water has a specific heat twice that of a hydrocarbon oil and will transfer heat two to three times faster than an oil, water is a superior coolant. However, water, by itself, has very little lubricating value. Accordingly, numerous attempts have been made to combine lanolin and water in stable solutions or emulsions for use as lubricating coolants in metalworking operations.

For example, U.S. Pat. No. 2,672,976 to Overath et al., describes a metalworking lubricating consisting of an aqueous emulsion of wool fats and fatty acids saponified with alkali metal hydroxide. This lubricant composition, even as noted by Overath, however, is unsuitable for use with hard water.

In U.S. Pat. No. 4,206,059 to Burton et al., an aqueous emulsion of wool fats, saponified with sodium hydroxide, is proposed as a metalworking lubricant. To achieve a more stable emulsion, Burton describes a cumbersome, multi-step process involving blending melted wool fat with cellulose, circulating the blend with mineral oil under back-pressure through a shearing device, saponification with sodium hydroxide, and then adding sequentially with heat and stirring, ethoxylated alkylphenol, insert filler and finally water. Naturally, such a lengthy and involved process is not very suitable for commercial operations. Further, the lubricant proposed by Burton contains a large amount of mineral oil rendering the lubricant ecologically unattractive.

A mineral oil-free fluid is described in U.S. Pat. No. 4,390,436 to Hernandez. The described water-based metalworking lubricant contains lanolin, a fatty acid amine soap and a thickener in combination with wax. The aqueous metal working fluids of Hernandez, while highly satisfactory in may respects, tend to form a water-insoluble coating on the surface of the workpiece during certain metalworking operations and therefore such compositions generally cannot be continually circulated as a lubricating coolant. Further, it has been found that these compositions can be sensitive to hard water.

Accordingly, it is an object of the present invention to provide novel lanolin emulsions and emulsifiable concentrates for water-based metalworking fluids.

A further object of this invention is to provide hard water-stable lanolin emulsions and emulsifiable concentrates for water-based metalworking lubricating coolants.

Another object of this invention is to provide lanolin emulsions for metalworking fluids that can be readily prepared.

Another object of this invention is to provide a method of cooling and lubricating metal during a metalworking operation.

Another object of this invention is to provide lanolin emulsion concentrates for formulating water-based metalworking fluids.

Yet another object of this invention is to provide a lanolin and water emulsion lubricating coolant for metalworking fluids.

Still another object of this invention is to provide a mineral oil-free lanolin emulsion for metalworking fluids.

Additional objects of the present invention are set forth in, or will be apparent from, the following description of the invention.

SUMMARY OF THE INVENTION

This invention relates to lanolin emulsions and emulsifiable concentrates for water-based metalworking fluids. The lanolin emulsions contain water, lanolin; a fatty acid; an amine; and a non-ionic surfactant. The emulsifiable concentrates contain lanolin; a fatty acid; an amine; and a non-ionic surfactant. For convenience, the term "lanolin emulsion" will include the term "emulsifiable concentrate", i.e., the mixture of the emulsion without the water component.

The lanolin emulsions of the present invention are for water-based metalworking fluids. Blending the lanolin emulsions witnh a substantial amount of water readily forms the metalworking fluids which are a second embodiment of this invention. The metalworking fluids comprise lanolin; a fatty acid; an amine; a non-ionic surfactant; and a major amount of water.

Another embodiment of the present invention is a method of lubricating and cooling metal during a metal working operation by contacting the metal involved in the metalworking operation with an effective lubricating and cooling amount of lanolin emulsion.

The lanolin emulsion metalworking fluids of the present invention have unexpectedly been found to be stable in hard water. Indeed, the lanolin fluids actually display increased lubricity when formulated with hard water or when electrolytes are added thereto.

Accordingly, a further embodiment of the present invention is lanolin emulsions and metalworking fluids which comprise lanolin; a fatty acid; an amine; a non-ionic surfactant; and at least one electrolyte. The electrolyte is present in an amount sufficient to enhance the lubricity characteristic of the metalworking fluid formed by aqueous dilution of the lanolin emulsion.

The lanolin emulsions of the present invention are readily diluted in water to obtain water-based metalworking fluids to lubricant and cool surfaces in frictional contact during metalworking operations such as turning, cutting, drilling, peeling, grinding and the like. The metalworking fluids may also be used as hydraulic fluids in metal pressing operations. The metalworking fluids of this invention are characterized by their stability in hard water and their excellent lubrication and coolant properties in the working of both ferrous and non-ferrous metals. The metalworking fluids are particularly useful for the machining of soft aluminum alloys. Additionally, the lanolin emulsion fluids, including any lubricating film imparted to the metal surface, generally remain water-soluble throughout the metalworking operation, and therefore are effective as circulating lubricating coolants. As the metalworking fluids of this invention are preferably free of mineral oil, they are also ecologically superior to conventional aqueous mineral oil metalworking compositions.

DETAILED DESCRIPTION OF THE INVENTION

The present invention relates to lanolin emulsions for water-based metalworking fluids. Each composition is comprised of the essential components: lanolin; a fatty acid; an amine; and a non-ionic surfactant. Unless otherwise provided, all amounts herein are in parts by weight.

Lanolin in any of its commercial grades can be utilized in the emulsions and metalworking fluids of the present invention. It is preferred however that a grade of lanolin of high purity, such as anhydrous lanolin grade USP (United States Pharmacopoeia), be utilized. Lanolin provides lubricity properties to the metalworking fluids. Generally, the more lanolin present, the better is the lubrication. At least about 2 weight percent lanolin is normally needed in a finished metalworking fluid to provide effective lubricity. On the other hand, excessive amounts of lanolin tend to result in gelling of the metalworking fluids.

Gels normally should be avoided due to attendant problems in handling, pumping and applying gel compositions in metalworking operations. Gel formation is usually not a problem in the metalworking fluids of this invention when the lanolin concentration is less than about 13 weight percent. Therefore, preferred lanolin metalworking fluids contain from about 3 to about 12 weight percent lanolin. More preferred lanolin emulsions contain from about 5 to about 12 weight percent lanolin.

To solubilize the lanolin, at least one nonionic surfactant is utilized in accordance with this invention. The surfactant also aids in dispersing other functional additives in the aqueous metalworking fluids. The non-ionic surfactant employed is hydrophilic and, generally has an HLB (hydrophilic/lipophilic balance) value in the range of about 9 to about 20. See for example, McCutcheon's "Detergents and Emulsifiers", North American Edition 1984, published by McCutheon's Division, MC Publishing Corporation, Glen Rock, N.J., U.S.A., which is hereby incorporated by reference, for its disclosure in this regard.

Suitable nonionic surfactants are the alkylene oxide-treated phenols, alcohols, esters, amines, amides and mixtures thereof. Examples of such nonionic surfactants include the sorbitan esters of oleic, stearic, isostearic, palmitic and lauric acids; the mono- and di-glycerides of fatty acids; the polyethoxylated esters of tall oil, castor oil and lanolin; and mixtures thereof. Polyethoxylated fatty acid esters having at least about 7 ethoxy units, and mixtures thereof, are especialy useful surfactants in the present invention. Exemplary nonionic surfactants of this latter group include the PEGANATE brand surfactants marketed by Borg-Warner Chemicals, Inc.

As the non-ionic surfactant is present to solubilize the lanolin, its concentration in the lanolin emulsion will be directly proportionate to the lanolin concentration. Generally, at least about 1 part non-ionic surfactant is used per 5 parts of lanolin, on a weight basis. Greater amounts of non-ionic surfactant may be employed to more readily form an emulsion, but excessive amounts bestow no commensurate benefit. The concentration of surfactant in the lanolin emulsion and metalworking fluids will typically range from about 0.25 to 2 parts by weight per each part lanolin. The preferred surfactant concentration is from about 0.3 to 1 parts by weight.

The lanolin emulsions and metalworking fluids of this invention also include at least one fatty acid to further impart lubricity characteristics and also to impart cleansing characteristics to the metalworking fluids. Suitable fatty acids include lanolin fatty acid, tall oil, stearic acid, oleic acid, recinoleic acid, palmitic acid, myristic acid, lauric acid, isostearic acid and mixtures thereof. Typically, commercially available fatty acids are sold with the designation of the primary or major components. Therefore, a commercial grade of stearic acid actually will contain some percentage of other fatty acids such as oleic acid, recinoleic acid, palmitic, isostearic and lauric acids. Lanolin fatty acids, tall oils and mixtures thereof are preferred fatty acids.

Normally, at least about 2 weight percent fatty acid is needed in a finished metalworking fluid to provide effective cleaning. However, employing large amounts of fatty acids together with large amounts of lanolin tends to result in an unstable metalworking fluid. Generally, the combined amount of lanolin and fatty acid should be less than about 25 weight percent of the finished metalworking fluids in order to avoid problems of instability. Accordingly, from about 0.15 to about 12 parts of fatty acid can be employed in the lanolin emulsion part per lanolin, on a weight basis. Preferred lanolin emulsions of this invention contain about 0.15 to about 6 parts by weight fatty acid per each part lanolin. More preferred lanolin emulsions contain about 0.5 to about 1 part fatty acid per part lanolin.

At least one amine is employed in the compositions of the present invention to form amine soap with the fatty acid component. The amine soaps are known to have some lubricating properties and added to the lubricity characteristics of the metalworking fluids. In addition the amine soaps provide cleansing properties to the metalworking fluids to clean the metal surfaces of metal chips and fragments during metalworking operations. Alternatively, amine soaps can be employed as a separate component instead of adding the corresponding amine and fatty acid components.

Suitable amines for use in the composition of the present invention may be primary, secondary or tertiary and are those that have a boiling point sufficiently high that they will not flash off under the conditions of the lanolin emulsion preparation and will form a soap with the fatty acid. Particularly useful amines are amines which are known to be corrosion inhibitors for metalworking fluids. Employment of amine corrosion inhibitors in amounts in excess of the fatty acids serves a dual purpose of forming amine fatty acid soap and providing corrosion inhibition.

Representative amine-type corrosion inhibitors are methylethanolamine, diethanolamine, triethanolamine, N-methylmorpholine, N-ethylmorpholine, ethylenediamine, dimethylaminopropylamine, dimethylethanolamine, alpha- and gamma-picoline, piperazene, isopropylaminoethanol, and mixtures thereof. Preferred amines are isopropylaminoethanol, diethanolamine and mixtures thereof.

The amount of amine employed should be sufficient to provide the desired acid value of the fatty acid component of the lanolin emulsion. Typically, 0.12 to 1.5 parts amine per part fatty acid, on a weight basis are employed. Excess amine is preferred, as it will impart corrosion inhibition properties to the metalworking fluids.

The balance of the lanolin metalworking fluids and emulsions is water. In general, water is not necessary to form the emulsifiable lanolin concentrates of this invention. Once formed, the lanolin emulsion may then be diluted with water to form a metalworking fluid of suitable viscosity. Also the emulsifiable lanolin concentrate can be diluted at its point of manufacture to form an emulsion concentrate of suitable viscosity for shipping and then be further diluted at the site of intended use. Preferably the emulsion concentrate fluid will contain from about 40 to about 80 weight percent water. The metal working fluids are readily formed by adding water to the emulsion concentrate or emulsifiable concentrate and blending. Usually, the emulsion concentrate to water ratio is about 1:1 to about 1:50, advantageously from about 1:10 to about 1:50 and preferably from about 1:15 to about 1:25. The optimum dilution ratio will depend on a variety of factors, such as, for example, the exact composition of the lanolin emulsion, the particular metal involved in the operation, the type of metalworking operation and hardness/softness of the water and is readily determinable to one skilled in the art.

In addition to the aforesaid components, electrolytes, extreme pressure agents, thickeners, dispersants, antiwear agents, corrosion inhibitors, antimicrobial agents, and other lubricants can be added to the lanolin emulsion or to the metalworking fluids.

The addition of electrolytes to the emulsions and fluids of the present invention has been found to enhance the lubricity of the metalworking fluids. This is quite unexpected as heretofore the presence of electrolytes has caused the destabilization of lanolin emulsions. Electrolytes can be present in the lanolin emulsions of this invention generally in amounts up to about 4 weight percent. However, with electrolytes present in amounts greater than about 2 weight percent, the lanolin emulsions tend to gel. It is therefore advantageous that lanolin emulsions contain from about 1 to about 2 weight percent electrolyte and preferably about 2 weight percent. Suitable sources of electrolytes include sodium borate, magnesium sulfate, calcium carbonate, magnesium chloride, hard water, mixtures thereof, and other salts.

In addition to the electrolytes provided in the lanolin emulsion, the lanolin emulsion may be diluted with hard water to provide further electrolytes in the finished metalworking fluids. Hard water containing electrolytes in amounts up to about 600 ppm can generally be used to make the metalworking fluids without causing appreciable separation of the lanolin emulsion.

A second optional, but preferred component of the lanolin emulsions and metalworking fluids of the present invention is a methyl or phosphate ester of a straight-chain or branched hydrocarbon. The use of such compounds has been found to increase the lubricity of the metalworking fluid, particularly when it is highly dilute. Generally, from about 0.1 to about 0.5 parts of binding ester per part lanolin is suitable to maximize lubricity.

Suitable ester compounds include water-soluble methyl esters which are known to be antiwear agents for metalworking fluids, such as the methyl esters of ethoxylated $C_8$–$C_{36}$ alkphatic monohydric or polyhydric alcohols with aliphatic acids and aliphatic dimer acids. An exemplary methyl ester is STEPAN C65 brand methyl ester marketed by Stepan Company.

Suitable phosphate esters include the phosphate esters known to be antiwear or extreme pressure agents for metalworking fluids. These phosphate esters are disclosed in U.S. Pat. Nos. 3,004,056 and 3,004,057 which disclosures are incorporated herein by reference.

The extreme pressure or antiwear agents that can be employed in the lanolin emulsions and metalworking fluids of this invention are those agents well known in the art to be useful for this purpose. In addition to the methyl and phosphate esters listed above, suitable agents include water-soluble esters of the ethoxylated $C_8$–$C_{36}$, aliphatic monohydric or polyhydric alcohols with aliphatic acids, and aliphatic dimer acids. Representative examples include esters of ethoxylated oleic acids, ethoxylated stearic acid, ethoxylated palmitic acid, ethoxylated oleic dimer acid, ethoxylated stearic dimer acids, and polyoxyethylene derivatives of sorbitan monooleate, sorbitan trioleate, sorbitan monostearate, sorbitan tristearate, sorbitan monopalmitate, sorbitan monoisostearate, and sorbitan monolaurate.

Additional suitable antiwear agents include the metal salts of acid phosphates, chlorinated hydrocarbons, and acid thiophosphate hydroxycarbyl esters, with zinc di(alkyl) or di(aryl)dithiophosphate being especially preferred. Examplary antiwear agents are LUBRIZOL 5604 marketed by The Lubrizol Corporation, and MOLYVAN L-B marketed by R. T. Vanderbilt Company, Inc.

The concentration of extreme pressure and antiwear agents in a finished metalworking fluid may range from about 0.05 to 6 percent by weight.

As thickeners for the lanolin emulsions and metalworking fluids of this invention, any conventional thickening agent normally may be employed. For example the modified polyether polyols described as thickening agents in U.S. Pat. No. 4,312,768, the methane thickeners described in U.S. Pat. No. 4,426,485, and the dimer ester thickeners disclosed in U.S. Pat. No. 4,317,740 may be utilized in the compositions of this invention. Combining urethane and dimer ester thickeners is particularly useful in providing superior rheological properties to the lanolin emulsions and metalworking fluids of the present invention.

The dispersants that can be used in the lanolin emulsions and metalworking fluids of this invention are those compounds well known in the art to be useful for this purpose. These compounds are useful for incorporating and dispersing oil-soluble, water-insoluble functional additives in the water-based metalworking fluids, e.g., antiwear and extreme pressure agents, such as dithiophosphates. For example, the carboxylic solubilizer/-surfactant combinations disclosed in U.S. Pat. No. 4,368,133 and the dispersant LUBRIZOL 5603 marketed by The Lubrizol Corporation may be used. The concentration of dispersant is not critical, but typically ranges from about 0.1 to 5 percent by weight in finished metalworking fluids.

Suitable corrosion inhibitors than can be employed in the lanolin emulsions and the metalworking fluids, depending on the metal to be worked, are conventional ferrous corrosion inhibitors and nonferrous corrosion inhibitors known in the art. The ferrous corrosion inhibitors act primarily as chelating agents for iron and its alloys. Boric acid and caprylic acid are preferred ferrous corrosion inhibitors. The concentration of ferrous corrosion inhibitors in the lanolin metalworking fluids is generally from about 0.05 to about 10 weight percent.

Non-ferrous corrosion inhibitors are used primarily as metal deactivators to chelate copper, aluminum, zinc and their alloys. Representative examples of these metal deactivators are benzotriazole, tolyltriazole, 2-mercaptobenzothiazole, sodium 2-mercaptobenzothiazole, and N,N'-disalicyclidene-1,2-propanediamine. Benzotriazole is a preferred non-ferrous corrosion inhibitor. The concentration of the non-ferrous corrosion inhibitor is not critical but typically varies from about 0.1 to 2 percent by weight of the finished metalworking fluid.

Amines, as set forth above, can also be employed in the compositions of this invention as corrosion inhibitors in addition to being present to form amine fatty acid soaps. The concentration of an amine as a corrosion inhibitor is not critical but typically ranges from 0.5 to 2 percent by weight of the finished metalworking fluid.

Additionally, biocides may be used to prevent microbial growth in the compositions. Biocides are well known in the art and any effective biocide may be utilized. Examples include phenolic derivatives, such as 2-phenyl phenol, 2-chlorophenol and 2,2'-methylene-bis (4-chlorophenol); formaldehyde release agents, such as the triazines, hexahydro-1,3,5-triethyl-s-triazine and hexahydro-1,3,5-tris(2-hydroxy-ethyl)-s-triazine, the imidazoles, e.g., 1,3-di(hydroxymethyl) 5,5-dimethyl-2,4-dioxolmidazole; aliphatic derivatives, such as, 2-bromo-2-nitropropane-1,3-diol; organosulfur-nitrogen compounds, such as, the thiazoles, and 1,2-benzisothiazolin-3-one. These and other suitable biocides are disclosed in Tribology International, December 1983, Vol. 16 (6): 328–330. Preferred biocides are the triazines and sodium omadine. The biocide concentration typically ranges from about 0.05 to 5 percent by weight of the total weight of the finished metalworking fluid.

The most preferred lanolin emulsions and metalworking fluids of this invention are totally mineral-oil free. However, it may be desirable to use mineral oil as an additional lubricant in some formulations. Synthetic lubricants might also be employed to provide additional lubricity.

Conventional techniques for forming emulsions may be used to produce the lanolin emulsions of the present invention. A preferred process is a hot-melt process. Once acceptable hot-melt process is to charge all of the organic ingredients (lanolin, fatty acid, nonionic surfactant) into a vessel and mix with heating until a homogeneous blend is achieved. The amine is then added with mixing to the hot solution. Thereafter a heated solution of water and any inorganic anti-microbial agent is charged to the vessel with mixing to obtain a homogeneous emulsion. The lanolin emulsion is then cooled and further diluted with water, as desired, to form the water-based metalworking fluid. The emulsifiable concentrates are prepared in a similar manner as the emulsions with the exception that water is not employed.

The following examples are provided to illustrate the invention and are not to be construed as limiting in any way. It will be apparent to those skilled in the art that numerous variations of the examples are possible in accordance with the principles of the present invention.

EXAMPLE 1

A lanolin emulsion was prepared by charging to a mixing vessel, on a weight basis, 5.0% lanolin, anhydrous USP grade[1]; 3.0% Amerlate LFA[2]; 1.2% Peganate CO-16[3]; 5.0% Stepan C-65[4]; 1.5% Unitol DT-30[5]; 5.0% diethanolamine; 3.0% WSC X-10[6]; and 0.75% Peganate To-9[7]. These ingredients were mixed with heating to 180° F. to yield a homogeneous mixture. When the temperature reached 180° F., 1.5 weight percent morpholine was charged to the vessel. In a separate vessel was charged, on a weight basis, 73.55% deionized water which was heated to 180° F. and then 0.1% Omadine[8] was charged thereto. Next, the hot water solution was charged to the first mixture at 180° F. The combined mixture was cooled to 100° F. and 0.4% Vancide TH[9] was charged thereto resulting in the formation of a lanolin emulsion useful as a metalworking fluid. For economical reasons the emulsion is diluted with tap water in a ratio of 1:1 to 1:50 (emulsion:water) to provide a metalworking fluid with excellent lubricating and cooling properties.

1 Lanolin, anhydrous USP grade, is marketed by Rita Corporation.
2 Amerlate LFA is a lanolin fatty acid marketed by Amerchol Corp.
3 Peganate CO-16 is an ethoxylated caster oil marketed by Borg-Warner Chemical, Inc.
4 Stepan C65 is a methyl palmitate-oleate marketed by Stepan Co.
5 Unitol DT-30 is a tall oil fatty acid marketed by Union-Camp Corp.
6 WSC-X10 is an amine corrosion inhibitor marketed by Western Springs Corp.
7 Peagnate TO-9 is a polyoxyethylene (9) mono tallate marketed by Borg-Warner Chemicals, Inc.
8 Omadine is 1-hydroxyl-pyridine-2-thione.
9 Vancide TH is hexahydro-1,3,5-triethyl-5-triazine.

Additional exemplary embodiments of the present invention are set forth in Table I. The ingredients of the examples are by weight percent. All the examples are prepared using techniques substantially as described in Example 1.

TABLE I

| | EXAMPLE NO. | | | | |
|---|---|---|---|---|---|
| INGREDIENT | 2 | 3 | 4 | 5 | 6 |
| Lanolin, Anhydrous USP | 5 | 5 | 12 | 5 | 6 |
| Peganate CO-16 | 4 | 4 | 3.5 | 3.5 | 2 |
| Peganate TO-9 | | 2 | | | |
| Peganate TO-75[10] | | 3 | 3.5 | 2.5 | |
| Amerlate LFA | 3 | 3 | 6 | 3 | 2 |
| Unitol DT-30 | 4 | 2 | | 2.5 | 1.5 |
| Diethanolamine | 2 | 4 | 4 | 4 | 4 |
| Sodium Borate | | | | | 2 |
| Stepan C65 | | 6 | | 6 | 5 |
| Antara LP 700[11] | 6 | | | | |
| OA-950[12] | | | 7 | | |
| WSC-X10 | | | | 2 | 2.5 |
| Vancide TH | | | | | 0.4 |
| Sodium Omadine, 40% | | | | | 0.1 |
| Deionized Water | 76 | 71 | 64.0 | 71.5 | 74.5 |
| | 100% | 100% | 100.0% | 100.0% | 100.0% |

[10]Peganate TO-75 is an ethoxylated caster oil marketed by Borg-Warner Chemicals, Inc.
[11]Antara LP 700 is an alcohol of a phosphate ester marketed by GAF, Corporation.
[12]OA-950 is a chlorinated fatty acid marketed by Witco Chemical Corp.

The compositions of the above examples are fully finished lanolin emulsion useful as metalworking fluids but are usually, for economical purposes, diluted with from about 1 to about 50 parts by weight of water per part of emulsion. As stated previously, lanolin concentrates may be prepared as described above except without water and thereafter blended with water at the point of use to there form the finished metalworking fluid.

EXAMPLE 7

The lubricating ability of the metalworking fluid of Example 1 was measured on a Falex lubricant testing machine with 7075 T-6 aluminum pin and V-blocks. The testing was conducted according to the procedures outlined in Faville, et al., Falex Procedures for Evaluating Lubricants, ASLE, Twenty-third ASLE Annual Meeting (May 1968).

The metalworking fluid of Example 1 was tested at a 1:20 dilution with water. Coefficients of friction were determined at direct jaw loads between 1000 and 2800 pounds, at 200 pound intervals. The average coefficient of friction over this range is set forth in Table II.

TABLE II

| Metalworking Fluid | Dilution | Coefficient of Friction |
|---|---|---|
| Example 1 | 1:20 | 0.05868 |

EXAMPLE 8

The cutting ability of the metalworking fluid of Example 1 was measured on a No. 8 Falex Tap Torque Tester with a specimen nut blank of 7075 P-6 aluminum and specifications of 0.33615±0.00015 in. (75% thread). The Tester was operated at the speeds and feeds outlined in Weer et al., Statistical Evaluation of the Falex Tapping Torque Tester, Lubrication Engineering (September 1980).

The metalworking fluid of Example 1 was tested as formulated and at dilutions with water of from 1:10 to 1:50. Each sample was run three times. The averaged results, in Newton-meters, are set forth in Table III.

TABLE III

| Metalworking Fluid | Dilution | Torque Value (Newton-Meters) |
|---|---|---|
| Example 1 | None | 4.2 |
| Example 1 | 1:10 | 4.8 |
| Example 1 | 1:20 | 7.22 |
| Example 1 | 1:30 | 8.59 |
| Example 1 | 1:40 | 9.12 |
| Example 1 | 1:50 | 9.65 |
| Example 1 | 1:10 | 4.63 |

EXAMPLE 9

To demonstrate the hard water stability of the metalworking fluids of this invention, 5 ml portions of the metalworking fluids of Example 1 were diluted with 95 ml of water containing various levels of electrolytes. The diluent water was prepared according to the Association of Analytical Chemists' Method 4.027 (1980) for preparing synthetic hard water. The diluted metalworking fluids were vigorously shaken in 100 ml graduated cylinders and the turbidity of the fluid was visually rated immediately after the shaking and after resting 24 hours. The results of this test are set forth in Table IV.

TABLE IV

| Water Hardness In PPM $CaCO_3$ | Turbidity Rating | |
|---|---|---|
| | Initial | 24 Hour |
| 350 | 0 | 3 |
| 450 | 2 | 3.5 |
| 600 | 2 | 5 |

Turbidity Rating Scale:
0 = None
1 = Very Slight
2 = Slight
3 = Slight-Moderate
4 = Moderate
5 = Moderate-Complete
6 = Complete

What we claim is:

1. In a metalworking operation in which a metalworking fluid that carries a lubricant in aqueous solution is continuously circulated over the metal involved to continuously impart both lubricity and cooling to the operation, the improvement for maintaining substantial stability of the fluid by preventing any appreciable formation of insolubles and their attendant deposition onto the metal, including the maintenance of substantial stability both in hard water and at extended aqueous dilutions, which comprises: formulating said fluid as a wax-free lanolin emulsion that in concentrated form before any dilution consists essentially of anhydrous lanolin in an amount from about 3% to about 12% by weight, fatty acid from about 0.15 to about 6 parts by weight per each part lanolin, at least one amine in an amount from about 0.12 to about 1.5 parts by weight per part fatty acid; and non-ionic surfactant in an amount from about 0.25 to about 2 parts by weight per each part lanolin and selected from the group consisting of alkylene oxide-treated phenols, alcohols, esters, amines, amides, fatty acids and mixtures thereof, and the balance being water.

2. The improvement of claim 1 wherein the fatty acid is selected from the group consisting of lanolin fatty acids, tall oils and mixtures thereof.

3. The improvement of claim 1 wherein the amine is selected from the group consisting of isopropylaminoethanol, diethanolamine and mixtures thereof.

4. The improvement of claim 1 further comprising an electrolyte.

5. The improvement of claim 1 further comprising a binding ester.

6. The improvement of claim 4 wherein the electrolyte is present in amounts from about 1 to about 4 weight percent.

7. The improvement of claim 4 wherein the electrolyte is present in amounts from about 1 to about 2 weight percent.

8. The improvement of claim 1 which is diluted with hard water containing up to about 600 ppm electrolyte.

9. The improvement of claim 1 wherein:

(a) the fatty acid is a lanolin fatty acid, a tall oil or mixture thereof;

(b) the non-ionic surfactant is an alkylene-oxide treated phenol, an alcohol, an ester, an amine, an amide, a fatty acid or mixtures thereof; and (c) the amine is isopropylaminoethanol, diethanolamine or mixtures thereof.

10. The improvement of claim 1 wherein:

(a) the surfactant is a polyethoxylated fatty acid ester having at least about 7 ethoxy units; and (b) the lanolin emulsion contains an effective lubricating-enhancing amount of electrolytes.

11. The improvement of claim 1 wherein the formulation contains an effective lubrication-enhancing amount of electrolytes.

* * * * *